US010946946B2

(12) United States Patent
Šifrer

(10) Patent No.: US 10,946,946 B2
(45) Date of Patent: Mar. 16, 2021

(54) SAIL CONSTRUCTION

(71) Applicant: MIDES DESIGN D.O.O., Ljubljana (SI)

(72) Inventor: Erik Šifrer, Ljubljana (SI)

(73) Assignee: MIDES DESIGN D.O.O., Ljubljana (SI)

( * ) Notice: Subject to any disclaimer, the term of this patent is extended or adjusted under 35 U.S.C. 154(b) by 0 days.

(21) Appl. No.: 16/620,834

(22) PCT Filed: Jan. 25, 2018

(86) PCT No.: PCT/IB2018/050470
§ 371 (c)(1),
(2) Date: Dec. 9, 2019

(87) PCT Pub. No.: WO2018/224892
PCT Pub. Date: Dec. 13, 2018

(65) Prior Publication Data

US 2020/0198745 A1 Jun. 25, 2020

(30) Foreign Application Priority Data

Jun. 8, 2017 (SI) ..... P-201700162

(51) Int. Cl.
*B63H 9/10* (2006.01)
*B63H 9/00* (2006.01)

(52) U.S. Cl.
CPC ..... *B63H 9/10* (2013.01); *B63H 9/00* (2013.01)

(58) Field of Classification Search
CPC .. B63B 15/00; B63H 9/00; B63H 9/04; B63H 9/06; B63H 9/08; B63H 9/10
USPC ..... 114/91, 97, 102.12, 102.16
See application file for complete search history.

(56) References Cited

U.S. PATENT DOCUMENTS

| | | | | |
|---|---|---|---|---|
| 4,940,008 | A * | 7/1990 | Hoyt | B63H 9/10 114/97 |
| 5,083,520 | A * | 1/1992 | Bonnet | B63B 15/0083 114/91 |
| 6,116,177 | A | 9/2000 | Conant | |
| 7,614,356 | B2 * | 11/2009 | Knisely | B63B 15/0083 114/91 |
| 2008/0156242 | A1 | 7/2008 | Knisely et al. | |

FOREIGN PATENT DOCUMENTS

| | | |
|---|---|---|
| EP | 0636541 A1 | 2/1995 |
| GB | 2030945 A | 4/1980 |
| NL | 9400478 A | 3/1995 |
| NL | 1033753 C2 | 10/2007 |

* cited by examiner

*Primary Examiner* — Lars A Olson
(74) *Attorney, Agent, or Firm* — Bryant J. Keller; Kirton McConkie

(57) ABSTRACT

Sail construction comprising foldable sail supports, a cross-beam, a holder, a sail, a bottom holder, ropes and a block and tackle system. The sail can be a self-inflatable sail designed similarly to paragliders, partially or fully inflatable.

30 Claims, 11 Drawing Sheets

SAIL CONSTRUCTION

BACKGROUND

Figure 1:
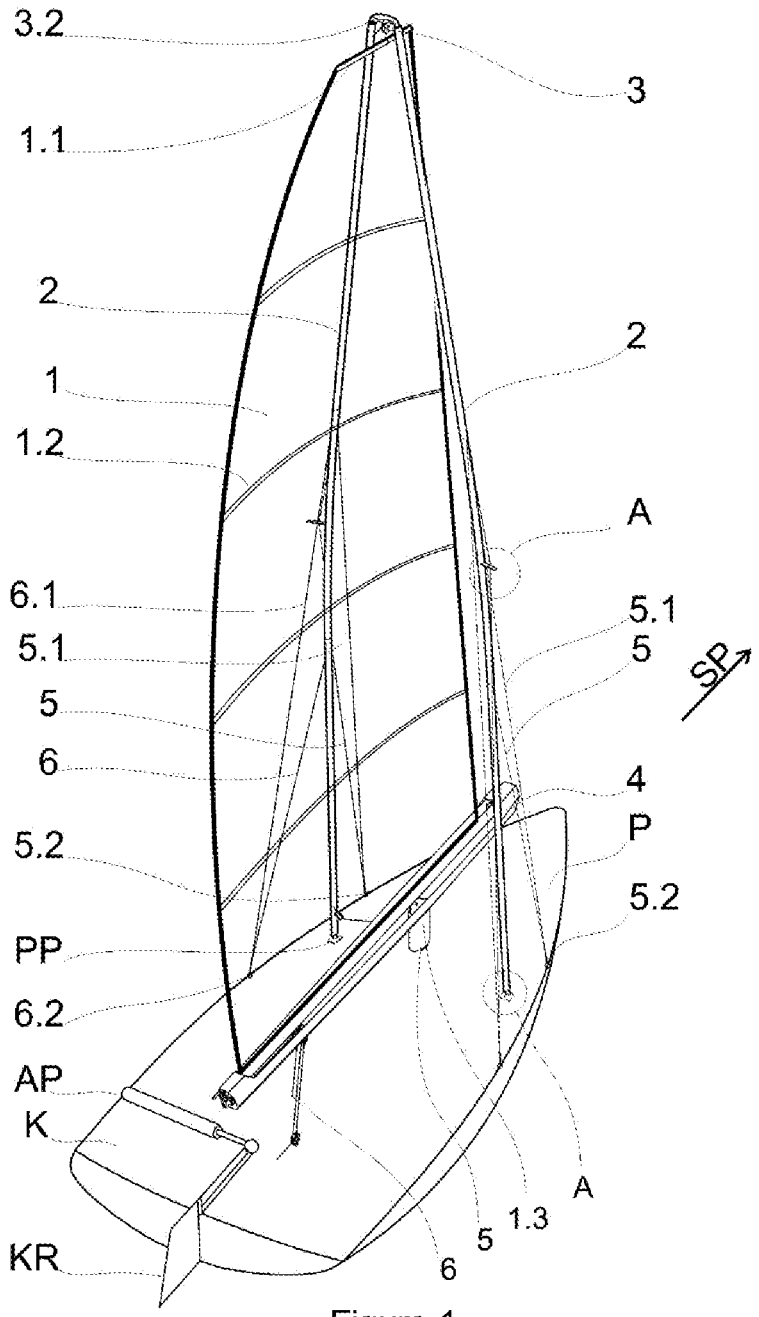

The invention concerns a sail construction without a mast replacing the role of the mast and at the same time allows setting up of all technically known sails for vessels or other means of transport.

The subject of the invention covers the entire system with elements that take over the function of the mast through its airfoils, and produce additional lift force in the direction of navigation of the vessel or other means of transport.

BRIEF SUMMARY OF THE INVENTION AND RELATED ART

The technical problem which is resolved by the invention is to provide such sail support construction that takes over the basic mast function and does not require auxiliary roping systems. In addition, it allows setting up of all known sail solutions.

The other technical problem which is resolved by the invention is that cross-sections of sail structure elements are designed as airfoils, which can, in parallel with the sail, also turn and reduce the air resistance and at the same time additionally increase lift force of the vessel in the direction of sailing due to the airfoil and rotation angle towards the wind incidence.

The fourth technical problem solved by the invention is that the sail structure can be simply folded down to a lower height, thereby facilitating the sailing of the vessel under bridges, etc.

Until now we have failed to observe any similar known solutions.

Below are listed the following patents from the SIPO patent database which outline and protect technical inventions in connection with the vessel sail and which are published under the following patent application numbers, namely:

Patent application No.: 22619

This patent shows a kayak with a retractable mast and sail. According to this patent, the mast can be quickly retracted, while the kayak can be used without the sail and vice versa.

This invention does not address the invention of the sail without a mast and therefore is not in any way related to our proposed invention, while the method of stacking the mast is completely different from that suggested by the proposed invention.

Patent application No.: 0989939

This patent deals with a sail with three light masts serving primarily for determining aerodynamic sail profile.

This patent does not address the sail without a mast and is entirely different from our invention.

Patent application No.: 9500182

This patent deals with a profiled sail. The proposed technical invention deals with the layout of aerodynamic ribs in the sail at the point of entry of the wind, which is located at the mast. It proposes wrapping the sail ribs around the mast.

This invention also does not address the invention of the sail without a mast and therefore is not in any way related to our proposed invention. In addition, the profiled sail is also designed in a completely differently way to that suggested by the proposed invention.

Patent application No.: 22790

This invention deals with similar technical inventions to the previous one, the only difference being that it proposes similar solutions for a trimaran sailing kayak.

This invention also does not address the invention of the sail without a mast and therefore is not in any way related to our proposed invention. The profiled sail of this invention is designed completely differently to that suggested by the proposed invention.

All of the above-mentioned patents represent known state of the art and do not offer technical solutions similar to our technical invention, which in essence does not use the mast for setting up the sail construction, which, composed of two supports, a connecting coupler and stays, may be folded to a lower height and that the cross-sections of the supports are made in the form of airfoils which are freely movable around the longitudinal axis or are controlled around the longitudinal axis in line with the sail in order to achieve lift forces in the direction of navigation of the vessel or any other vehicle due to wind flow.

DETAILED DESCRIPTION OF THE INVENTION AND BRIEF DESCRIPTION OF THE DRAWINGS

According to the invention, the solution* to the problem of eliminating the main mast or all masts is to set up two sail supports on each side of the mast with an airfoil designed through their respective cross-section, which can rotate around the longitudinal axis of sail supports, while it can also be controlled via a system used to rotate airfoils of sail supports in a certain correlation with the sail. In the middle or near the middle both sail supports are designed so that they can be folded back or forth in relation to the axis of the vessel or vehicle in order to be able to reduce the height at least by half. For this purpose, the flexible section of the two sail supports is fitted with a special joint, around which they rotate. On the upper side, the sail supports are connected with a transverse joint with a function of connecting the supports and the function of tensioning the sail upwards.

The supports are fastened to the vessel or vehicle by means of stays. Stacking of supports can also be carried out by releasing the stays.

According to the invention, any sail of optional shape and profiles can be mounted to this construction.

For this purpose, we can also use an inflatable sail with pockets or pre-inflatable sail which can be inflated using a manual pump or a compressor in order to form an airfoil at low wind speed and thereby generate lift force for the sail.

The sail can be clamped in the axes of the incidence angle or the axes of the aerodynamic lift force or optionally.

The present invention is outlined in the embodiment and the figures that display:

FIG. 1—shows the side view of the entire vessel with the complete system and standard sail, which is clamped through the axis of the aerodynamic point of application of the forces of the sail.

Figure 2:
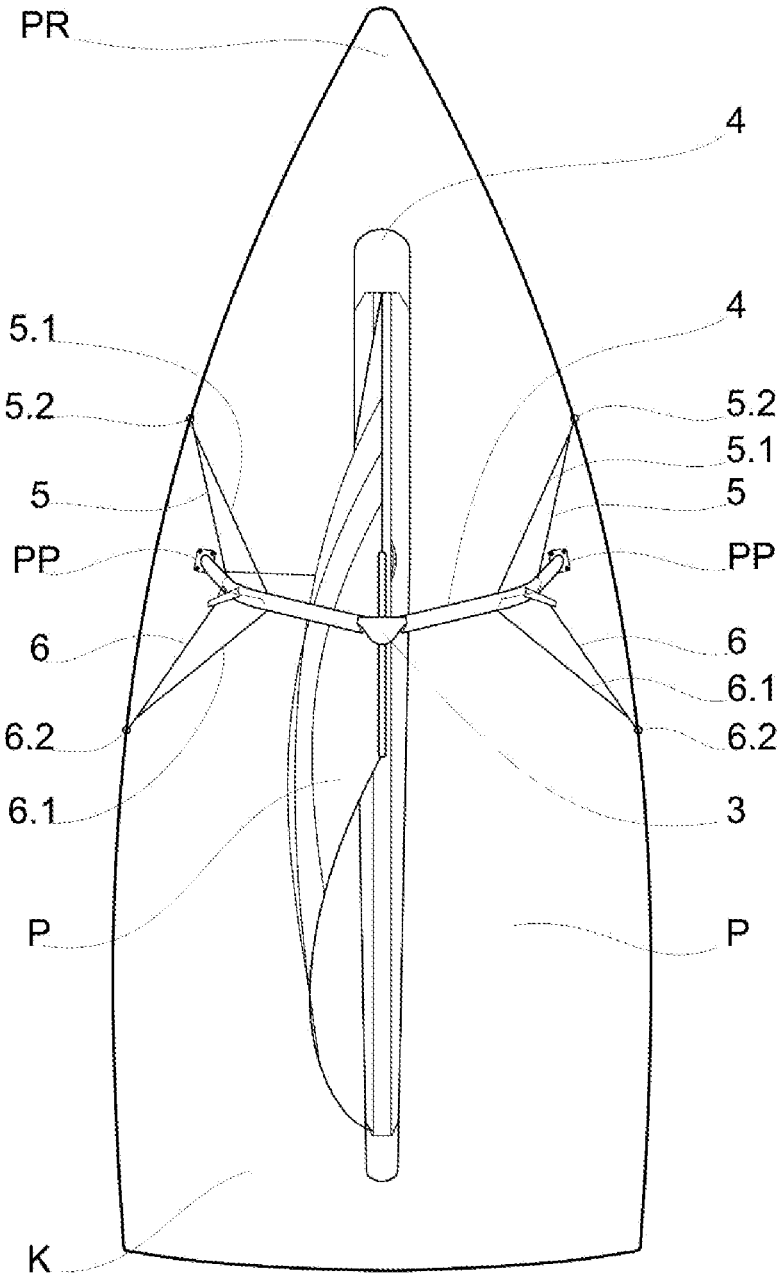

FIG. 2—shows the plan view of the entire vessel with the complete system and standard sail, which is clamped through the axis of the aerodynamic point of application of the forces of the sail.

Figure 3:
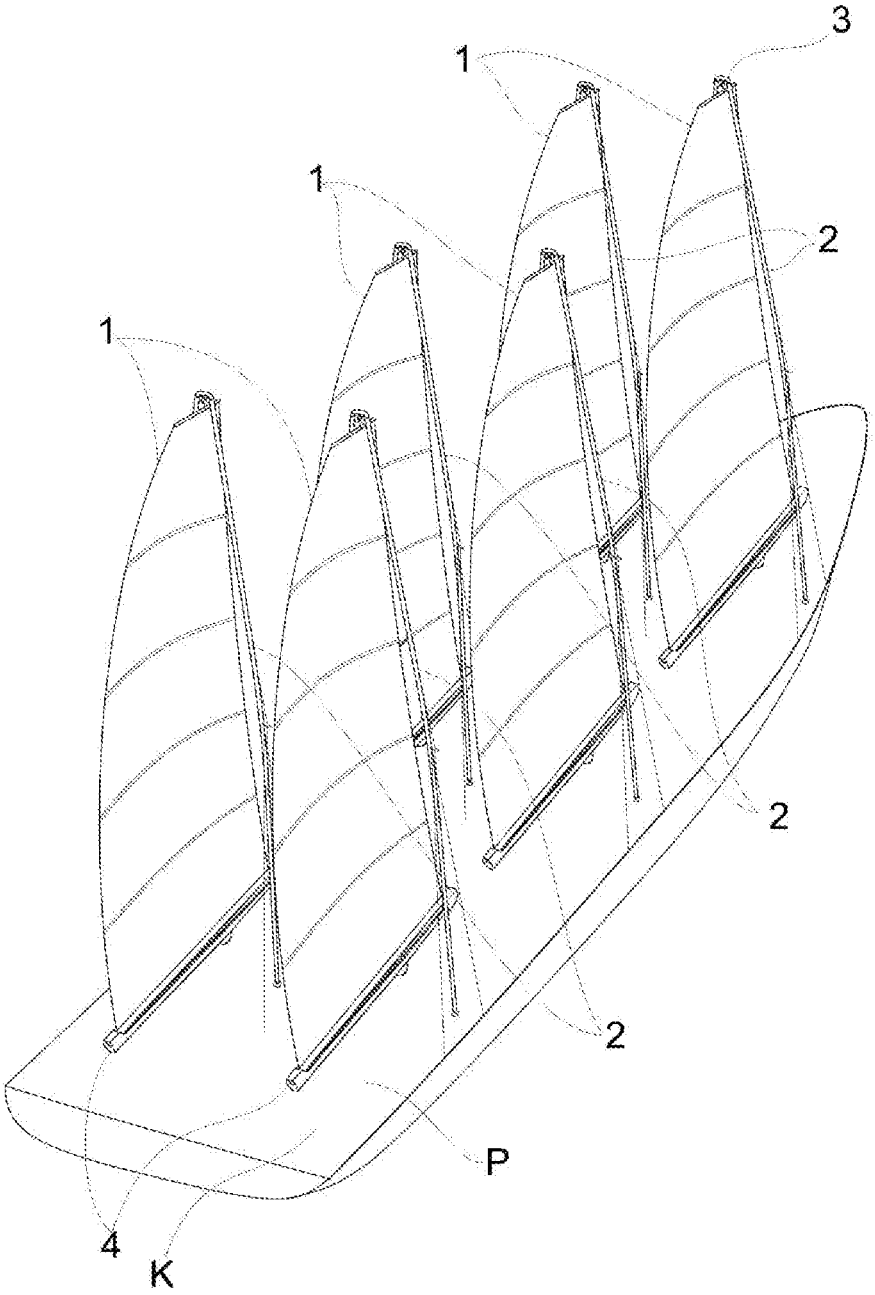

FIG. 3—shows the vessel with multiple mounted systems for fastening the sail, as outlined by the invention.

FIG. 4—shows the stacking of the sail support via a rotary swivel joint in the middle of the sail support.

Figure 5A:
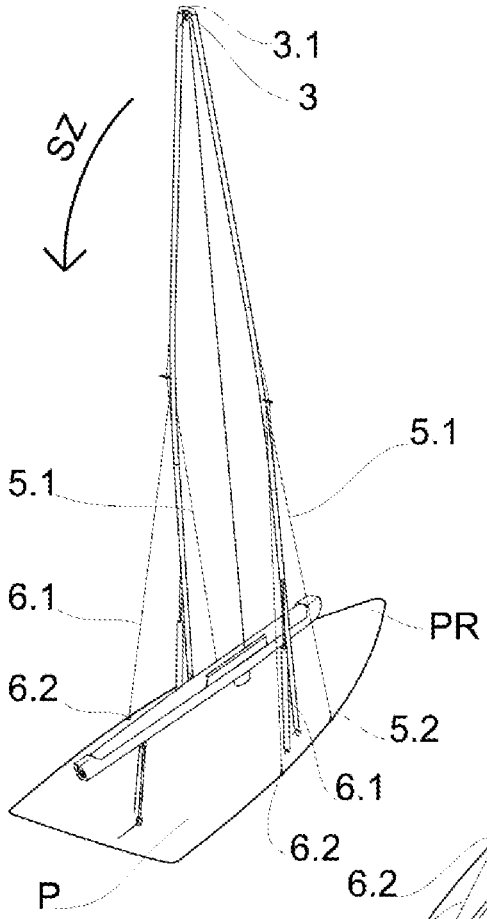
Figure 5B:
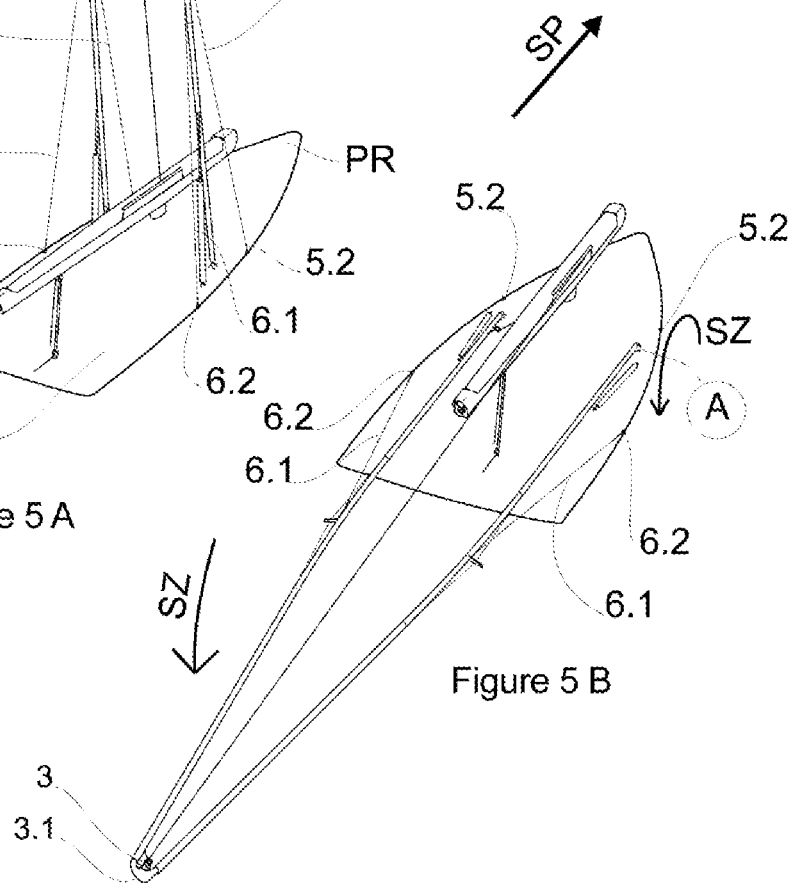

FIGS. 5A and 5 B—show the stacking of sail supports via a rotary swivel joint at the base or start of the sail support where only the stays 5.1 and 6.1 are installed. In this case, we do not necessarily need the stays 5 and 6.

Figures 6A, 6B:
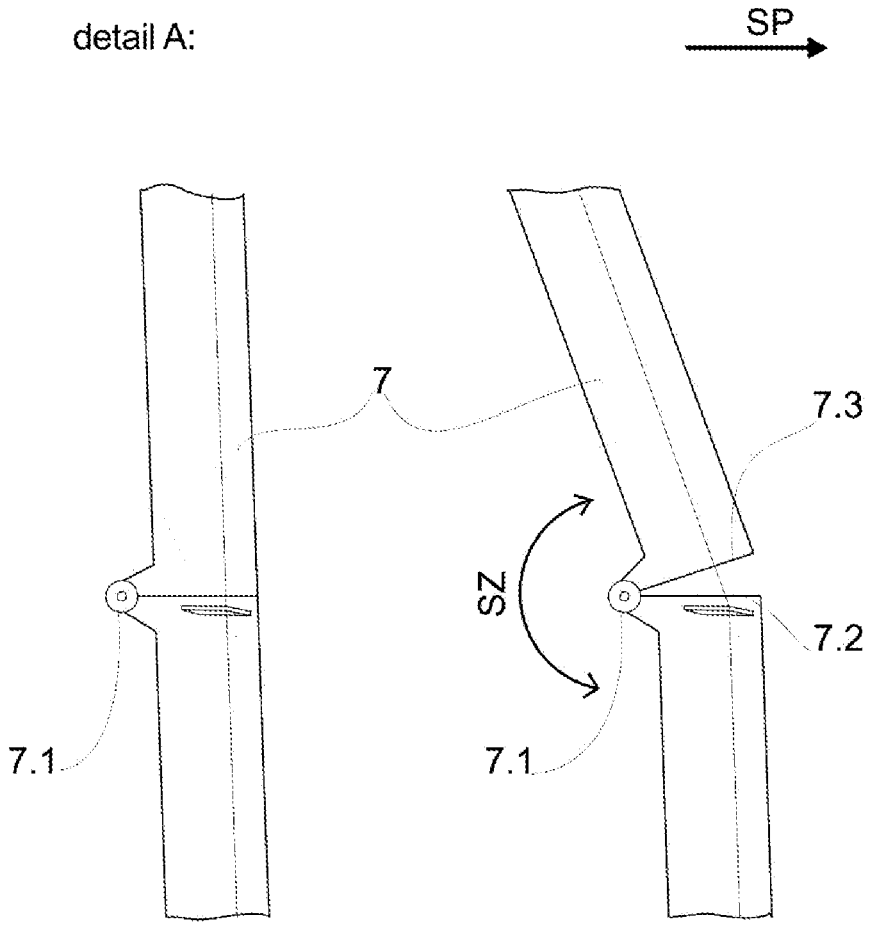

FIGS. 6A and 6B—show detail A from the FIG. 4 which shows a sectional joint of the sail support which can also be mounted on the vessel's deck on the bottom base part of the sail support.

Figure 7A:
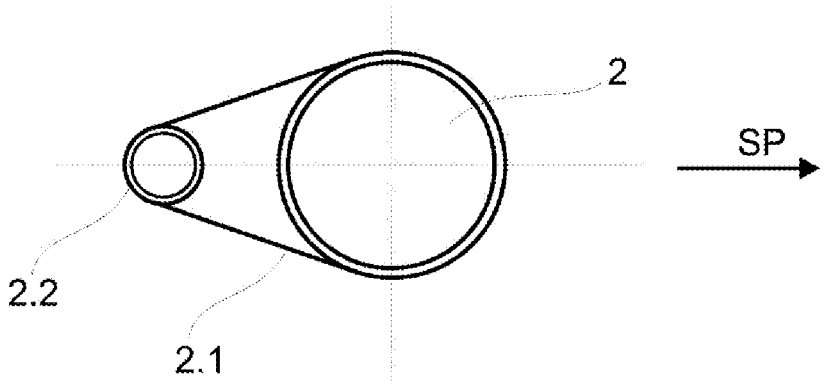
Figure 7B:
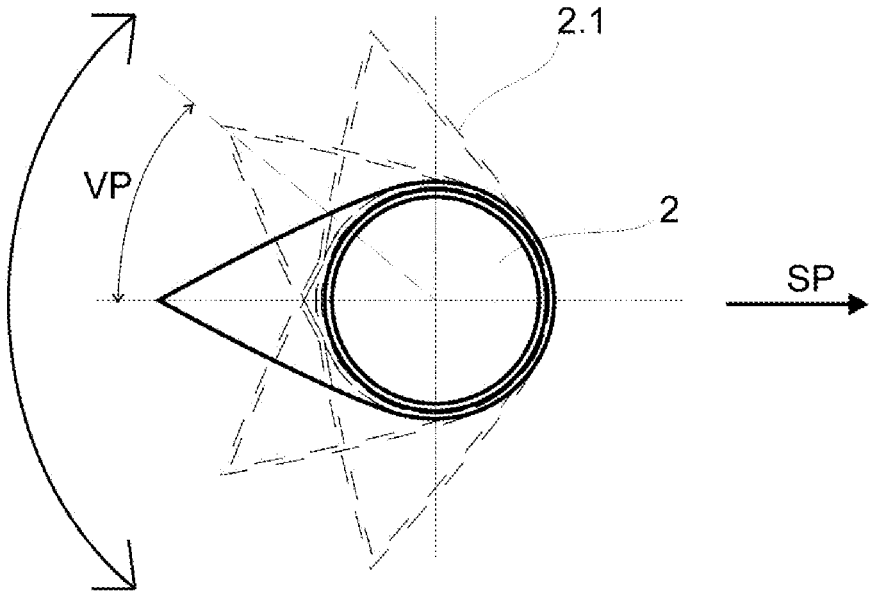

FIGS. 7A and 7B—shows the cross-section of the sail support where the airfoil and the manner of rotation around the longitudinal axis of the sail support are visible.

Figure 8:
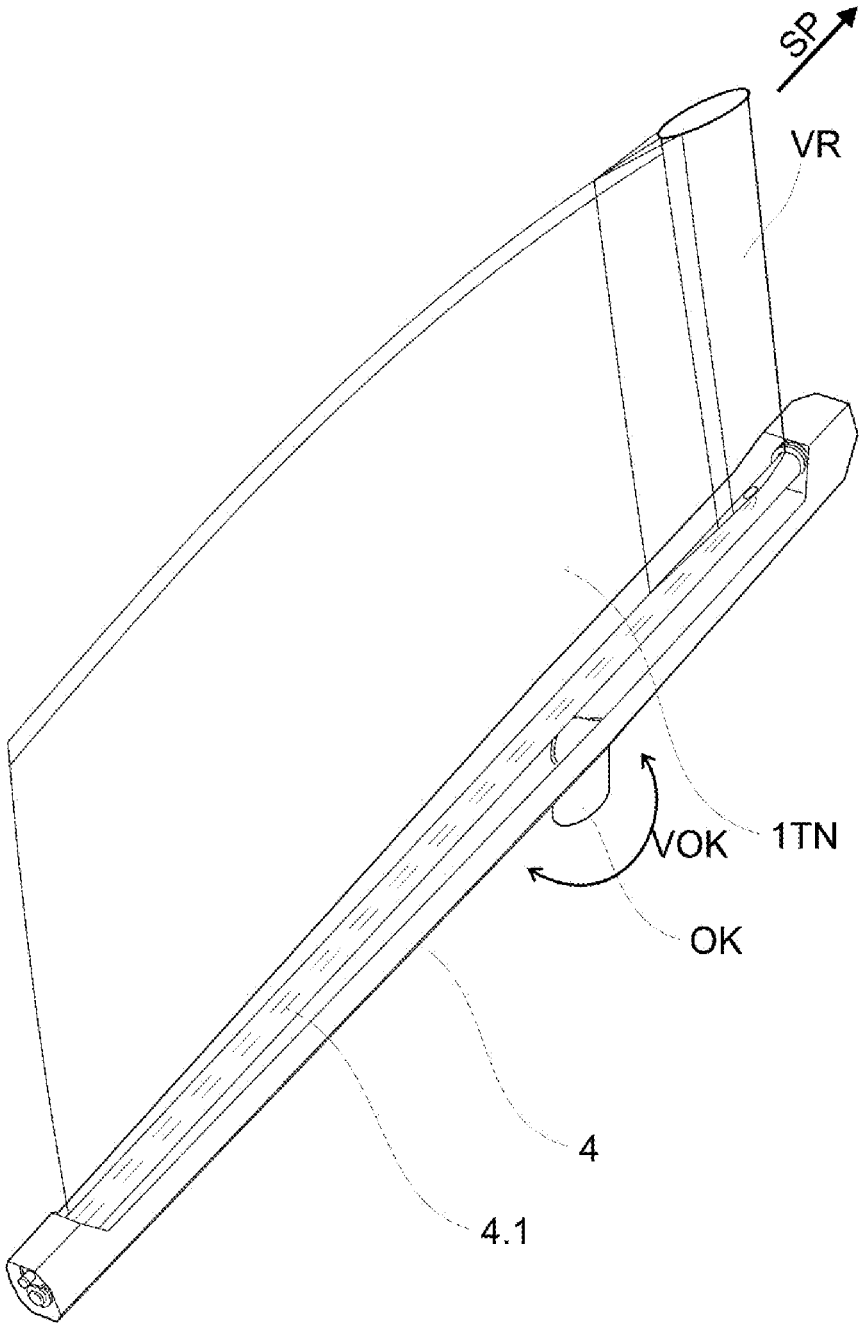

FIG. 8—shows the cross-section of a partially inflatable sail clamped into the sail construction without a mast.

Figure 9:
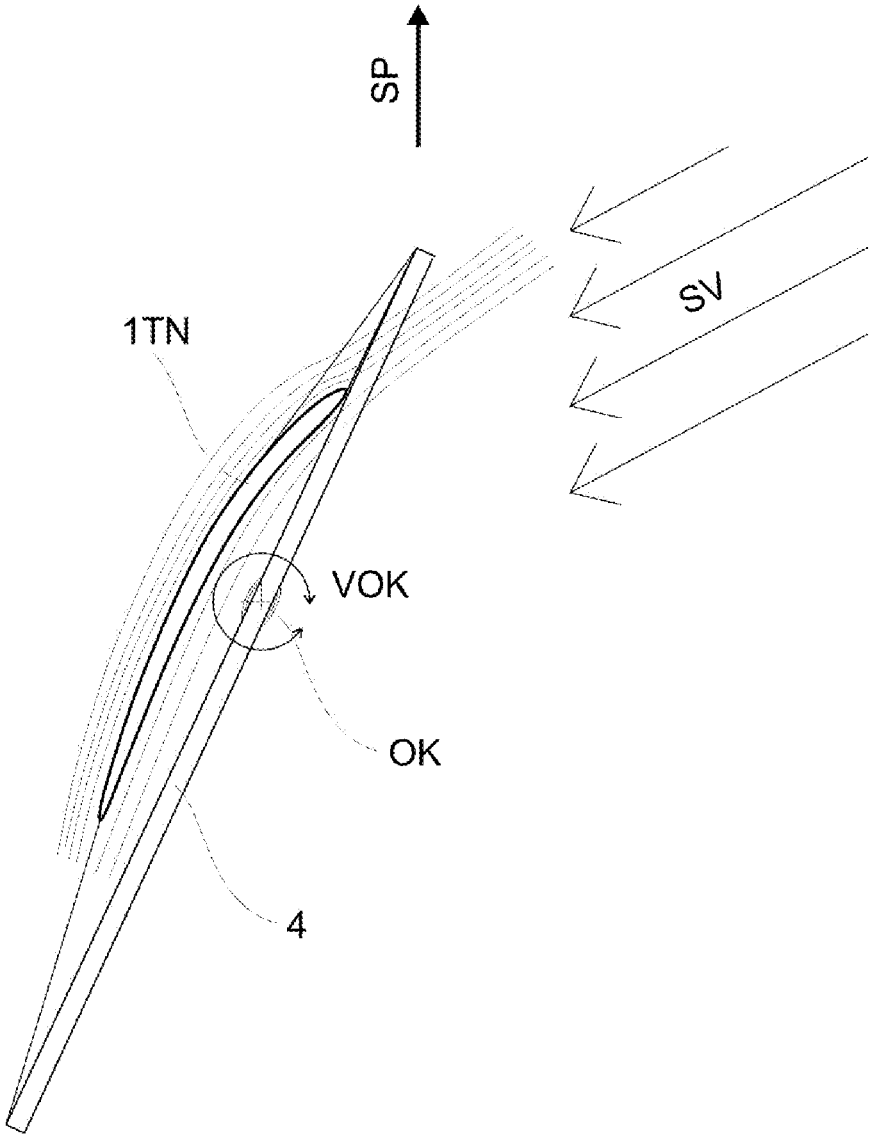

FIG. 9—shows the cross-section of a fully inflatable sail clamped into the sail construction without a mast, where the wind flow is schematically shown.

Figure 10:
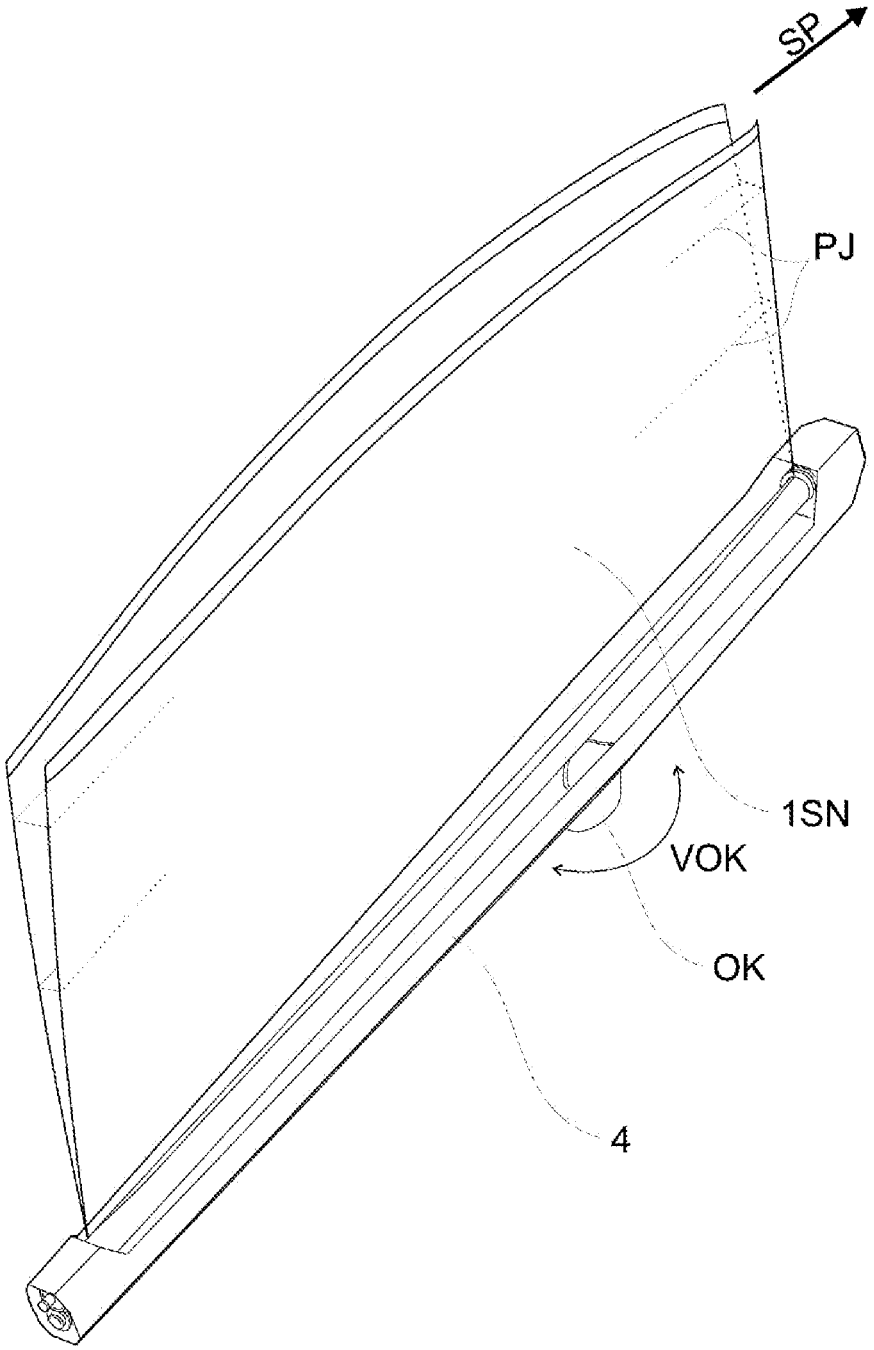

FIG. 10—shows the cross-section of the self-inflatable sail and illustration of clamping of the sail to the holder 4.

Figure 11:
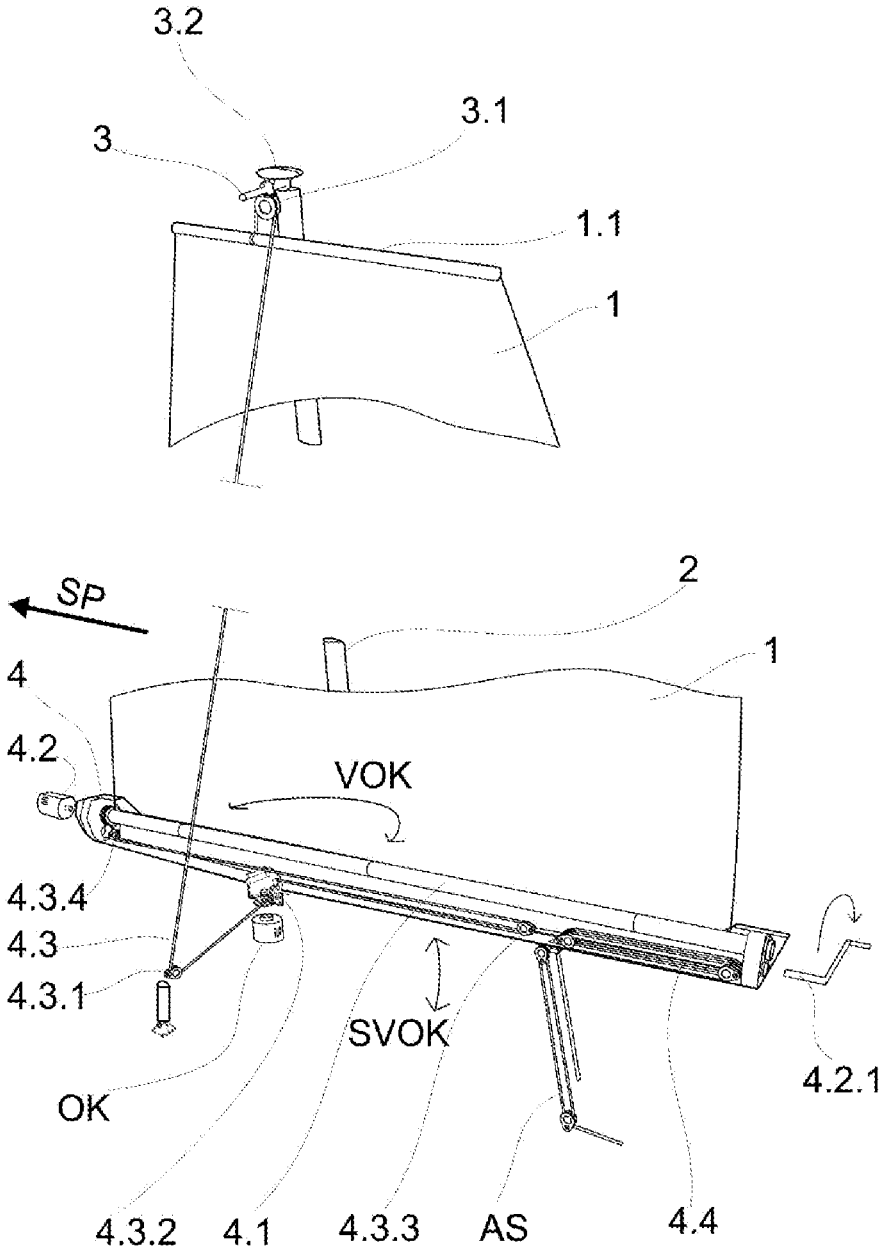

FIG. 11—shows the cross-section of the holder 4 with a shaft 4.1 in connection with the sail 1 and rope 4.3 for lifting and lowering of the sail 1, and the holder 4 control system.

The sail construction without a central mast is set on a vessel P or another vehicle as a single system or several systems that can be optionally installed. One of those variants is shown in FIG. 3.

A uniform system outlined by the invention consists of the following basic elements or components:

sail 1 which can in certain cases also be a self-inflatable sail 1 SN or a partially or fully inflatable sail 1 TN, two holders 1.1, two supports of the sail 2 which are installed on each side of the vessel P or sail 1, transversely to the sailing direction SP or vessel voyage direction P, connecting coupler 3 on which the upper block and tackle system 3.1 is mounted which is also the top fulcrum of the sail 1 that transfers the pre-tensioning force of the sail 1.

In addition, the technical assembly also consists of the bottom holder 4 which tensions the sail 1 downwards and also serves as a folding or storage compartment of the sail 1 and the fulcrum OK of the sail 1.

The sail 1 is tensioned over the rope, which can also be a braid or similar 4.3, that is in such a way that the holder 1.1, which is integrated in the upper section of the sail 1 is connected with a rope 4.3. The rope 4.3 runs through the pulley 3.1 or some other device installed on the connecting coupler 3 and on the deck of the vessel P, where it is fastened by any optional means. The second method is by allowing the rope 4.3 to run through the pulley 4.3.1, which is stopped on the deck of the vessel P, and which continues to run to the shaft 4.1 where the rope 4.3 is firmly fastened.

The shaft 4.1 is pivotally mounted in the middle of the cross-section of the holder 4 and can be driven by a manual drive 4.2.1 or by a motor drive 4.2.

This method is described in more detail below.

In the lower section, the sail 1 is clamped to the holder 4 with which it can be rolled onto the shaft 4.1 of the holder 4 or it is fastened optionally. If the holder 4 is fitted with a built-in shaft 4.1 for rolling the sail 1, the latter can optionally be shortened continuously during sailing by winding it onto the shaft 4.1 of the holder 4 and vice versa.

The sail supports 2 are fixed to the deck of the vessel P via known state of the art technical solutions, while the lower section of the supports of the sail 2 may be fastened to the deck of the vessel P via a special sectional joint 7 which is presented as detail A and is enlarged in FIGS. 6A and 6B.

The sail supports 2 can also be fitted with a built-in sectional joint 7 in the middle section of the length of the supports of the sail 2 or approximately in the middle section of the supports of the sail 2.

If the supports of the sail 2 have built-in sectional joints 7 also or only in the middle section of the length, the prerequisite is that the fastening of the stays 5 and 6 is installed under the sectional joint 7. This is necessary because the upper part of the sail support 2 can be folded back towards the direction of navigation SP only by releasing the stay 5.1.

It is desirable that the upper fastening of the stays 5 and 6 onto the supports of the sail 2 is as close as possible to the bottom part of the sectional joint 7 in order to achieve the highest possible static strength of the connecting part of the stays 5 and 6 and the support of the sail 2.

The bottom as well as the top fastenings of the stays 5, 5.1, 6 and 6.1 can be designed using any known technical methods.

If the sectional joint 7 is installed only on the lower part of the support of the sail 2, it is possible to stack the entire support system of the sail 2 and the connecting coupler 3 back towards the direction of navigation SP by releasing both bottom fastenings 5.2 for both of the stays 5 and 5.1.

The supports of the sail 2 rotate around the sectional joint 7 at an angle that is required for the upper parts of the support of the sail 2, or the connecting coupler 3 to be seated firmly on the deck of the vessel P where special cam washers are installed that can carry the mass of the folded sail structure.

When stacking the supports of the sail 2 on a smaller vessel P they may also be in contact the surface of the water on which the vessel P is sailing. For this purpose, the connecting coupler 3 may be designed in such a way that it has an additional built-in float 3.2 with a sufficiently large volume ranging from 20 to 200 litters to retain the connecting coupler 3 or the folded sail construction above the water surface using the mass of displaced water. Such a folded structure is illustrated on FIGS. 5A and 5B.

In the case that the sectional joint 7 is fitted only at the approximate centre of the length of the sail supports 2, we can stack the upper part of the sail supports 2 with the connecting coupler 3 back towards the direction of navigation of the vessel P by releasing both bottom fastenings 5.2 of both stays 5.1.

Figures 4A, 4B, 4C:
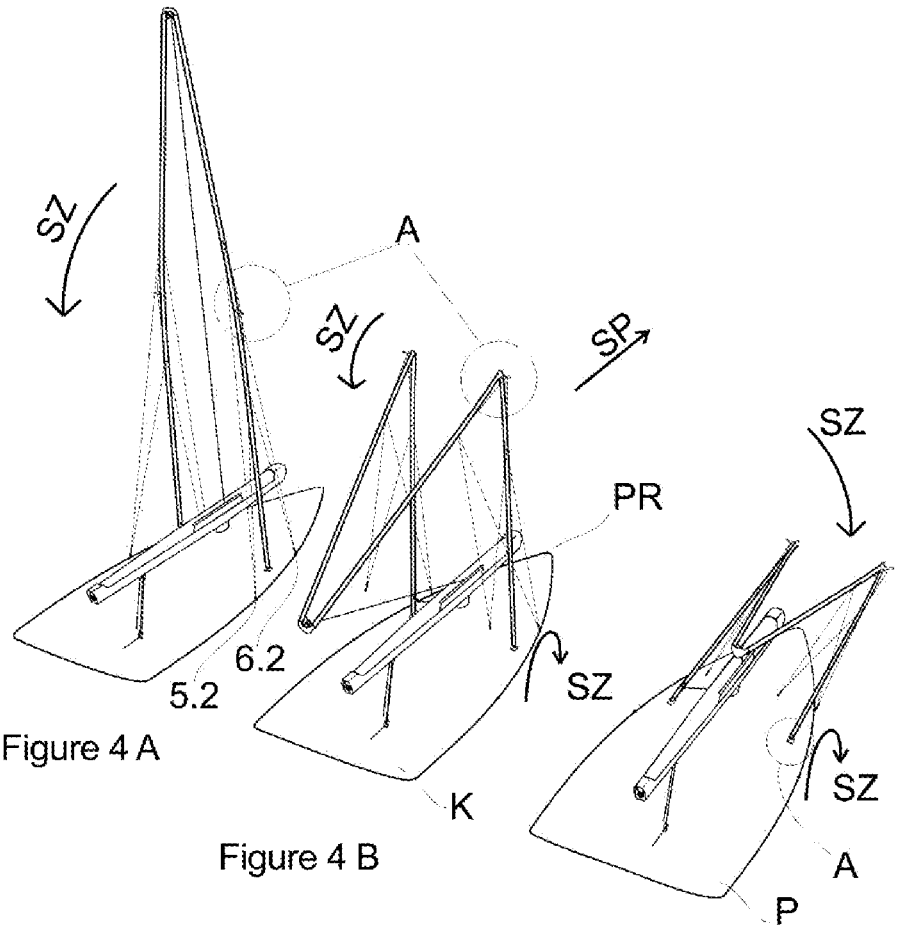

The upper parts of the sail supports 2 rotate around the fulcrum of the sectional joint 7 by an angle that is required to fit the upper part of the sail support 2, or the connecting coupler 3, to the lower holder 4 or to the special movable support for the float 3.1 to contact the water surface on the rear side of the vessel P. This type of folding is shown in FIGS. 4A and 4B.

The connecting coupler 7 may at the same time also be installed at both positions of the sail supports 2, as mentioned above. In this case, we can stack the sail supports 2 or the entire system by first releasing the lower fastenings 5.2 of the stays 5.1. Due to their own mass, the sail supports 2 rotate around the fulcrum of the sectional joint 7 back towards the stern K or in the opposite direction of the direction of navigation SP of the vessel P to the angle where the connecting coupler 3 seats on the holder 4 or onto special movable supports or similar.

We then also release the bottom fastenings 6.2 of the stays 6 and 6.1. Due to their own mass, the sail supports 2 that have previously already been stacked once also rotate around the fulcrums of the sectional joints 7 that are installed at the bottom in a forward direction towards the direction of navigation SP of the vessel P to such an angle that the edge of the sail support 2 sits on the deck of the vessel P or on the pre-installed movable holders that, while the connecting coupler 3 at the same time slides along the holder 4 or along the special movable holders in a forward direction towards the direction of the navigation SP of the vessel P. Such a method of stacking is shown in FIGS. 4A, 4B and 4C. With certain construction measurements, i.e. mainly with small vessels P, it is possible that the float 3.2 contacts the water surface before the vessel P does and holds the entire structure above the surface.

The sectional joint 7 is designed in such a way that the sail supports 2 can be rotated in one direction only by an angle of up to a maximum of 180 degrees. The sectional joint 7 is self-locking in the other direction of rotation.

The self-locking is performed in such a way that the fulcrum 7.1 of the sectional joint 7 is fitted on the side outside the cross-section of the sail support 2. However, the surfaces 7.2 and 7.3 of the sail support 2 are designed at such a position that the outstretched or open sail support 2 seats on the surfaces 7.2 and 7.3 in firm contact.

The surfaces 7.2 and 7.3 are joined and do not allow the rotation of the sectional joint 7 in the opposite direction as foreseen for stacking the sail support 2. This rotation around the sectional joint 7 is shown in FIGS. 6A and 6B.

Before stacking the sail supports 2, it is necessary to remove the sail 1 or store it into the holder 4. If you fail to do this before stacking the sail supports 2, this may result in a breakage of the entire system or cause damage to the sail 1.

The sectional joints 7 are always installed in such a way that the axis 7.1 of the sectional joint 7 is perpendicular to the direction of stacking of sail supports 2, or perpendicular to the vessel's (P) symmetrical axis.

V If a sectional joint 7 is only installed on the bottom part of the sail support 2, or at the deck of the vessel P, it must be oriented so that the axis 7.1 of the sectional joint 7 is closer to the stern K of the vessel P.

This way, when the sail support 2 is stacked, the upper part of the sail support 2 is rotated backwards around the axis 7.1 of the sectional joint 7 towards the stern K of the vessel P, and the surfaces 7.2 and 7.3 separate.

V In the case two sectional joints 7 are also installed or are installed only in the approximate centre of the middle section of the support of the sail 2, they must be installed in such a way that the axis 7.2 of the upper sectional joint 7 is closer to the stern K of the vessel P, while the axis 7.2 of the lower sectional joint 7 is at a distance from the stern K of the vessel P closer to the bow of the vessel P.

The axes 7.2 of the sectional joints 7 must be installed in such a way that they are parallel to each other. If the axes are not parallel, relatively large forces can act on the axis 7.2 due to stacking which are transferred to the sail supports 2 as torsional forces and can damage the sail supports 2 or fulcrums PP of the sail supports 2 on the deck of the vessel P and the fastening between transverse joint 3 and sail supports 2.

In order to eliminate the tolerance of design and installation of the sectional joints 7 on the sail supports 2, the axis 7.2 is designed in such a way that the fit of the axis 7.2 in the sectional joint 7 is very loose, and laxity of the fit of the axis 7.2 in the hole of the sectional joint ranges from 0.5 to 5 mm allowing torsional rotation in the range from 3 to 30 angular degrees.

Before starting the stacking of the sail supports 2 you must verify that the surfaces 7.2 and 7.3 of the sectional joint 7 are clean or that no foreign body is on these surfaces which would prevent a repeated rotation of the upper part of the sail support 2 or the entire sail support 2 to the basic position, where all parts of the sail support 2 which are installed under and above the sectional joint 7 are parallel, or positioned along the same symmetrical axis running along the length of the sail support 2.

In the middle between the sail supports 2 or below the connecting coupler 3, the holder 4 is pivotally mounted on the deck of the vessel P which is used to tension the sail 1 and at the same time also as a rolling or storage compartment of the sail 1.

The holder 4 has a mounted shaft 4.1 in the middle, to which the sail 1 is rolled up during folding or shortening thereof, or during the unrolling procedure when unfolding the sail 1.

The rolling of the sail 1 can be carried out using an electric motor with a gearbox 4.2. When the bolt and tackle system with an endless rope 4.3 that is described below is not used, the gearbox must employ a self-locking mechanism so that the shaft 4.1 cannot unfold so that the sail 1 remains taut. The rolling or unrolling of the sail 1 can also be carried out manually using the lever 4.2.1 which drives the built-in self-locking gearbox which can be a worm gear or similar.

The sail 1 is fitted with a holder 1.1 at the top, to which the rope of the system 4.3 is fixed which tensions the sail 1 through the pulley 3.1 that is mounted on the connecting coupler 3.

The sail 1 is tensioned using a considerable force which also determines the sail profile 1 in the longitudinal direction.

Due to the aerodynamic lift forces of the sail 1, relatively large pretension forces of the sail 1 are generated, therefore all components for pretensioning of the sail 1 must be designed taking into account a considerable safety factor.

The sail 1 pull-out and folding system with the so-called endless rope 4.3 is designed in such a way that the rope 4.3 is fastened to the holder 1.1 of the sail 1 on one side which then runs downwards through the pulley 3.1 onto the pulley 4.3.1 directing the rope 4.3 towards the holder 4. On the holder 4, the rope runs through the pulley 4.3.2 onto the pulley 4.3.3 which directs it to the pulley 4.3.4. This pulley directs the rope 4.3 perpendicularly to the shaft 4.1 where the rope 4.3 is firmly fixed.

When folding the sail 1, turn the shaft 4.1 which is mounted into the holder 4. This way, the rope 4.3 of the sail 1 lowering and lifting system starts winding onto the shaft 4.1. At the same time, the sail 1 starts winding onto the shaft 4.1. Due to the same winding track of the rope and sail 1 onto the shaft 4.1, the rope 4.3 is always taut and keeps the sail 1 always taut via the crosslink 1.1.

When the sail 1 is completely folded onto the shaft 4.1, it is stored in the holder 4. In this case, the rope 4.3 is also wound onto the shaft 4.1 in the holder 4.

When pulling out the sail 1, we follow the procedure in the opposite direction. By rotating the shaft 4.1 in the opposite direction, the rope of the system 4.3 pulling the sail 1 from the holder 4 via the pulley 3.1, begins to unroll. The sail 1 unfolds from the shaft 4.1 symmetrically to the rope of the system 4.3.

In this way, you can pull out the sail 1 to the desired height in a continuous manner. The trimming and pulling out of the sail 1 is carried out without ropes that would be an interfering element on the deck of the vessel P.

The pulling out or shortening or folding of the sail can be motor driven by an electric motor 4.2 or manually using the lever 4.2.1. In both situations a regular or self-locking gearbox with an integrated brake is used.

The use of the gearbox or the brake integrated with the gearbox 4.2 is desirable to additionally lock the rotation of the shaft 4.1, thereby enabling the force of pretensioning the sail 1, although the rope 4.3 is endless and pretensioned in order to prevent unrolling of the shaft 4.1.

When you do not use the continuous rolling/unrolling using the rope 4.3 as described above, but tension/lowering the sail 1 using the pulley 3.1 by means of an ordinary rope fixed on the deck of the vessel P, we must use self-locking a gearbox or gearbox with an integrated brake 4.2.

In the event that the electric motor 4.2 is used, the sail 1 can be completely automated and the trimming of the sail and the position of the helm KP of the vessel P can be connected via computer with the autopilot AP of the vessel P.

The holder 4 is fixed to the deck of the vessel P so that it can rotate around the control axis OK which can be at any chosen length of the holder 4. The fastening of the holder 4 to the deck of the vessel P can be carried out in a variety of ways, namely using all known technical methods, whereby it must be designed in such a way that it can easily transfer all the forces of pretensioning of the sail 1 and the forces generated by the aerodynamic forces and the wind resistance forces of the sail 1.

The holder 4 is fixed to the control axis OK so that it can freely, or with a torque of up to 50 Nm, tilt transversely to the longitudinal axis in the direction S VOK within the limits of −25 to +25 angular degrees.

The movable fastening of the holder 4 to the control axis OK can be carried out using all known technical solutions with the condition that they can easily transfer all loads that occur due to the sail tension 1 and the aerodynamic forces of the sail 1 acting on the vessel P.

The tilting of the holder 4 in the direction of SVOK can be necessary in order to tension the sail 1 evenly over the entire surface of the sail 1 due to tensioning, particularly on the rear edge, since the holder 4 and with it the bottom clamping of the sail 1 adapts to the actual shape or dimensions of the selected sail.

To control the holder 4 around the VOK axis VOK which indirectly controls the sail 1, various systems can be used which represent known state of the art. The most basic system is shown in FIG. 11 and represents the rope assembly AS which is wrapped around the bolt and tackle system, through which the rope is locked fixed on the deck of the vessel P.

The control can also be carried out in more simple ways such as by using a control rod which can be sectionally clamped at the rear end of the holder 4 or in a more sophisticated manner where the fulcrum OK of the holder 4 is clamped to the control gearbox with an electric motor or any other engine mechanism. The gearbox must either have an integrated brake or have a self-locking mechanism so that the positioned holder 4 stays in the desired location.

The control mechanism drive of the holder 4 can also be connected with the autopilot AP of the vessel P, or it can be controlled in any other way.

The airfoils 2.1 which are installed along the length of the two sail supports 2 can be designed as indicated in the FIG. 7A or FIG. 7B.

In the example shown in the FIG. 7A a built-in tube 2.2 is located on the exit edge of the profile which increases the airfoil stability and prevents injuries to the crew when colliding with the exit edge of the airfoil 2.1 of the sail support 2.

The FIG. 7B shows an airfoil without an integrated tube on the exit edge. However, both airfoil surfaces 2.1 are assembled to form a sharp edge.

The airfoil is mounted on the sail supports 2 and can freely rotate around them.

Free play between the airfoil 2.1 and sail support 2 ranges from 0.5 mm to 15 mm which is enough for the airfoil 2.1 not to get stuck to the sail support 2 profile even with small wind forces, but rotates freely in the direction of the slightest wind resistance SV.

The airfoils 2.1 can have free rotation owing to wind flow SV. This reduces wind resistance on the sail supports 2 and enables more efficient use of the vessel P.

Rotation of airfoils 2.1 of the sail supports 2 can also be executed through mechanical controls using any known method. In this case, it is desirable to rotate the airfoil 2.1 of the sail support 2 by exactly the same angle VP in order to obtain a higher lift force of the profile 2.1 in the direction of navigation SP of the vessel, and at the same time the minimum resistance force of the wind flowing around the airfoil.

The airfoils 2.1 control can be carried out in correlation with the rotation control VOK of the holder 4 or the sail 1 around the axis OK or an integrated stand-alone system can be used that turns the airfoils 2.1 for VP angles that offer optimum lift force in the direction of the vessel P and minimum air resistance in the direction of navigation SP of the vessel P.

In this case, the control must be connected with the helm angle gauge, VOK angle of the holder 4 around the axis OK, speed gauge and angle of the wind SV, via a computer displaying information about the speed and course of the vessel P, the inclination of the vessel P from the autopilot AP.

The sail 1 can be single-layered, as is well known in most cases. By folding the sail 1 longitudinally by rolling it onto the shaft 4.1, the sail 1 can have built-in bars 1.2 that form airfoil cross-sections of the sail 1.

By using such a sail 1, the aerodynamic lift force of the sail 1 is greatly improved. There can be 10 pieces of bar 1.2 per linear metre of the sail 1.

Another feature of the sail which can be used with the present invention is the so-called inflatable sail 1 SN which has integrated pockets formed by the internal links PL of both layers of the self-inflatable sail 1 SN which are designed in a similar way as with paragliders.

This roughly means that the proposed invention allows the installation of segments of paragliders.

The construction of paragliders with integrated open, due to air flow, self-inflatable pockets which shape an airfoil, is technically known and is not outlined separately.

This airfoil shape of the self-inflatable sail 1 SN provides the so-called thick airfoils which generate large lift forces at low wind speed SV. Therefore, the use of such a self-inflatable sail 1 SN is a far better choice than the use of a classical single-layer sail 1.

However, the use of such a self-inflatable sail 1 SN which has integrated self-inflatable pockets, is disabled or unfeasible in technical terms with vessels P which are equipped with a central mast since the self-inflatable sail 1 SN in this case cannot be freely hung in the construction, but is clamped to the mast with the front edge which in this case disrupts the aerodynamic potential of the self-inflatable sail 1 SN.

The FIG. 10 shows a cross-section of the self-inflatable sail 1 SN with visible connections PJ on both layers of the sail.

The third sail feature that can be used in the proposed invention is the so-called inflatable sail 1 TN which can be inflated by overpressure using a manual pump or compressor. In this case, the inflatable sail 1 TN consists of chambers or has along the airfoil length built-in layer connections PJ between both layers which determine the shape of airfoils of the inflatable sail 1 TN along the entire length of the inflatable sail 1 TN.

The connections PJ can be carried out in a similar way as for connections PJ on the self-inflatable sail 1 SN, whereby in this case the inflatable sail 1 TN is completely closed off also at the entry and exit edges.

This type of sail 1 TN is shown in the FIG. 9 which also illustrates wind flow SV.

The inflatable sail 1 TN can also be inflated only at the entry edge VR. This type is shown in the FIG. 8. Such a sail 1 TN is called a partly-inflatable sail 1 TN. However, if the sail can be inflated throughout the cross-section, it is called a fully-inflatable sail 1 TN.

In the case of shortening, folding or rolling on the shaft 4.1 of inflatable sails 1 TN, the pressure in the inflatable sail 1 TN must be relieved. Having relieved the pressure, you can roll the inflatable sail 1 TN onto the shaft 4.1. When the inflatable sail 1 TN has been once again fixed with the rope 4.3, you can inflate it by using overpressure to achieve the desired airfoil.

Inflatable sails 1 TN are not specifically outlined since this represents the already known state of the art. However, it has not yet been used for this purpose, i.e. as a sail on vessels, because the central mast prevented this. The proposed invention also outlines and proposes the use of all described sail systems which range from classical single-layer with or without bars, self-inflatable, as well as partially- or fully-inflatable ones.

The invention claimed is:

1. A sail construction for a vessel, the sail construction comprising:

two foldable sail supports mountable on a deck on each side of the vessel and having an airfoil arranged freely rotatable around a longitudinal axis of each of said two foldable sail supports, a connecting coupler for connecting said two foldable sail supports on their top, a sail that is configured to be supported by said two foldable sail supports, a holder for holding and tensioning said sail upwards, a bottom holder pivotally mountable on the deck of the vessel in a middle between said two foldable sail supports, wherein the bottom holder is arranged to tension and to roll said sail and is arranged as a storage compartment of said sail, a system of ropes, a block and tackle system, and forestays, and backstays, for fastening and pre-tensioning elastically said two foldable sail supports on the vessel, wherein a rope of said system of ropes is arranged to run through a first pulley mounted on said connecting coupler to said holder for lifting and lowering said sail, and wherein at or near a middle of their length, both of said two foldable sail supports are designed so that they can be folded back or forth in relation to an axis of the vessel in order to be able to reduce a height at least by half.

2. The sail construction according to claim 1, wherein an inflatable float with a volume ranging from 20 to 200 litres is arranged to be installed on the connecting coupler.

3. The sail construction according to claim 1, wherein the rope can be drawn from the holder, where it is fixedly clamped through the first pulley to a second pulley leading it to a third pulley which leads it to a fourth pulley and the bottom holder, where this fourth pulley turns its route and directs it to a fifth pulley and the bottom holder which once more turns the rope perpendicularly to a shaft at the bottom holder where the rope is fixedly clamped to the shaft.

4. The sail construction according to claim 1, wherein a section of the sail is fixedly clamped into the bottom holder using any known method.

5. The sail construction according to claim 4, wherein a bottom section of the sail is configured to be fixedly clamped to a shaft which is mounted in a center of the bottom holder.

6. The sail construction according to claim 5, wherein the sail is arranged to be continuously rolled up and unrolled using the shaft, while the shaft transfers pretension forces of the sail and aerodynamic components of wind forces acting on the sail.

7. The sail construction according to claims 5 or 6, wherein in case a classical manner of rolling/unrolling the sail is used, the shaft is equipped with a built-in self-locking gearbox in extension which can be activated with a lever.

8. The sail construction according to claims 5 or 6, wherein instead of or besides a hand-operated drive, the shaft is configured to accommodate a built-in gearbox in extension which includes a self-locking mechanism or have an integrated brake, and be driven by an electric motor in case use of a classical manner of lifting/lowering the sail is desired.

9. The sail construction according to claim 3, wherein the sail is configured to be lifted/lowered using an endless rope, wherein the sail is on one side fastened to the holder, while on another side the sail is fastened to a shaft, wherein a gearbox gearboxes is configured to operate the shaft which is not self-locking and is without an integrated brake, while at least one of a self-locking gearbox and a gearbox with an integrated brake can also be used.

10. The sail construction according to claim 1, wherein the two foldable sail supports are clamped to the vessel on a bottom section via a built-in sectional joint.

11. The sail construction according to claim 1, wherein the two foldable sail supports each have a built-in sectional joint at an approximate center of a length of the two foldable sail supports.

12. The sail construction according to claim 11, wherein upper fastening elements of the forestays and backstays are mounted on the two foldable sail supports just below the built-in sectional joint which is mounted at the approximate center of the length of each of said two foldable sail supports.

13. The sail construction according to claims 10 or 11, wherein the built-in sectional joint in an extended or a closed position has a self-locking mechanism on one side so that surfaces of the built-in joint fit onto each other, while during opening of the built-in sectional joint an upper part of one of said two foldable sail supports rotates around an axis of the built-in sectional joint to an angle that ranges from 0 to a maximum of 180 angular degrees.

14. The sail construction according to claim 13, wherein an axis of the built-in sectional joint of a first of said two foldable sail supports and an axis of the built-in sectional joint of a second of said two foldable sail supports both run in a parallel manner while at a same time perpendicularly in a direction of stacking of said two foldable sail supports.

15. The sail construction according to claim 10 or 11, wherein an axis in the built-in sectional joint fits loosely ranging from 0.5 to 5 mm such that the built-in sectional joint allows torsional rotation in the axis of the built-in sectional joint that can range from 3 to 30 angular degrees.

16. The sail construction according to claim 9, wherein if only a single one of the built-in sectional joints is installed on a bottom part of each of the two foldable sail supports on the deck of the vessel, the axis of each of the built-in sectional joints is oriented to be closer to a stern of the vessel, while at the same time perpendicularly a symmetrical axis of the vessel.

17. The sail construction according to claim 14, wherein where a lower set of the built-in sectional joint is mounted on said two foldable sail supports on a bottom part of the deck of the vessel and an upper set of the built-in sectional joint is mounted on each of said two foldable sail supports at approximately half of a length of the two foldable sail supports, the lower set of the built-in sectional joint is oriented so that axes of the lower set of the built-in sectional joint are closer a bow of the vessel, while axes of the upper set of the built-in sectional joint are closer to a stern of the vessel, and all axes of the upper set and the lower set of the built-in sectional joint are parallel to each other and oriented perpendicularly to a symmetrical axis of the vessel.

18. The sail construction according to claim 4, wherein the bottom holder is pivotally mounted on the deck of the vessel through a fulcrum which is located at an approximate third of a length of a bottom airfoil depth.

19. The sail construction according to claim 18, wherein the fulcrum transfers forces of pretensioning the sail and aerodynamic wind force components acting on the sail via the bottom holder to the vessel.

20. The sail construction according to claim 19, wherein the bottom holder can be controlled around the fulcrum in a direction with a rope assembly which is wrapped around a so-called block and tackle system with which the bottom holder is fastened to the deck of the vessel.

21. The sail construction according to claim 19, wherein the bottom holder can also be controlled around the fulcrum in a direction using a self-locking gearbox which can be hand- or electrically-operated or using some other servo drive.

22. The sail construction according to claim 21, wherein the bottom holder can be controlled around the fulcrum in the direction using a gearbox with an integrated motor that is connected to an autopilot of the vessel.

23. The sail construction according to claim 21, wherein the bottom holder is fixed to a control axis so that the bottom holder can freely, or with a torque of up to 50 Nm, tilt transversely to the longitudinal axis of one of said two foldable sail supports in the direction within the limits of 25 to +25 angular degrees.

24. The sail construction according to claim 1, wherein a free play between the two foldable sail supports and the airfoils is arranged to range from 0.5 to 15 mm.

25. The sail construction according to claim 24, wherein airfoil rotations around the longitudinal axis of each of the two foldable sail supports can be controlled using known systems that are connected with an autopilot of the vessel.

26. The sail construction according to claims 1 or 6, wherein the sail is configured to be clamped between the holder and the bottom holder, wherein said sail has up to 10 built-in bars per linear meter of a height of the sail, while the bars are designed lengthwise as sail airfoils so that together with the sail they form an ideal airfoil of the sail, and the sail can be rolled up together with the built-in bars using the bottom holder.

27. The sail construction according to claim 26, wherein the sail comprises a self-inflatable sail that is clamped between the holder and the bottom holder with sewn-in connections which form open pockets that because of wind flow create an airfoil of the self-inflatable sail.

28. The sail construction according to claim 26, wherein the sail comprises a so-called inflatable sail that is clamped between the holder and the bottom holder and that comprises of chambers or in other words includes between both layers, viewed longitudinally of airfoils of inflatable sail built-in connections of both layers which determine a shape of airfoils of the inflatable sail along an entire length of the inflatable sail while an overpressure in the inflatable sail is achieved using a manual or an electrically-operated pump or a pump operated in any other way.

29. The sail construction according to claim 28, wherein an only inflatable part of the inflatable sail is a front edge of the inflatable sail.

30. A method for installing the sail construction according to claims 1, 2, 3, 4, 5, 6, 9, 10, 11, 12, 16, 18, 19, 20, 21, 22, 23, 24, or 25 on the vessel wherein a processes of stacking said two foldable sail supports is carried out by releasing at least one of the forestays and the backstays.

* * * * *